US008154296B2

(12) United States Patent
Guo et al.

(10) Patent No.: US 8,154,296 B2
(45) Date of Patent: Apr. 10, 2012

(54) CATHODIC PROTECTION MONITORING

(75) Inventors: Junxiang Guo, Bristol (GB); Jonathan Lakin, Bristol (GB); Nnanna Kalu Okwun-Kalu, Bristol (GB)

(73) Assignee: Vetco Gray Controls Limited, Nailsea, Bristol (GB)

( * ) Notice: Subject to any disclaimer, the term of this patent is extended or adjusted under 35 U.S.C. 154(b) by 0 days.

(21) Appl. No.: 12/943,347

(22) Filed: Nov. 10, 2010

(65) Prior Publication Data

US 2011/0129302 A1 Jun. 2, 2011

(30) Foreign Application Priority Data

Nov. 30, 2009 (GB) ..... 0920878.6

(51) Int. Cl.
*G01N 27/08* (2006.01)

(52) U.S. Cl. ..... 324/425; 324/700

(58) Field of Classification Search ..... 324/425, 324/700

See application file for complete search history.

(56) References Cited

U.S. PATENT DOCUMENTS

| | | | | |
|---|---|---|---|---|
| 4,437,065 | A | 3/1984 | Woudstra | |
| 5,587,707 | A * | 12/1996 | Dickie et al. | 340/870.09 |
| 2004/0051649 | A1 * | 3/2004 | Hudson | 340/852 |

FOREIGN PATENT DOCUMENTS

| | | | |
|---|---|---|---|
| EP | 1054078 | A2 | 11/2000 |
| GB | 2017306 | A | 10/1979 |
| JP | 59113187 | A | 6/1984 |
| JP | 61217588 | A | 9/1986 |
| JP | 02156095 | A | 6/1990 |
| WO | 2008110625 | A1 | 9/2008 |

OTHER PUBLICATIONS

GB/0920878.6; Search Report and Written Opinion, Dated Mar. 16, 2010.

* cited by examiner

*Primary Examiner* — Vincent Q Nguyen
(74) *Attorney, Agent, or Firm* — Bracewell & Giuliani LLP

(57) ABSTRACT

A method of monitoring cathodic protection of an item located at an underwater facility having an item requiring cathodic protection, and the facility are provided. The facility can include a processing device. The steps can include providing a pair of first and second electrodes, the first electrode being electrically connected to the item and the second electrode being in contact with water proximate the item, measuring the potential between the first and second electrodes, producing an electrical signal indicative of the cathodic protection level, converting the signal into a communications format compatible with the processing device and passing it to the processing device, and transmitting the converted signal from the processing device to a surface location.

14 Claims, 2 Drawing Sheets

CATHODIC PROTECTION MONITORING

BACKGROUND OF THE INVENTION

1. Field of the Invention

The present invention relates to a method of monitoring cathodic protection of an item located underwater at a facility and an underwater facility having an item requiring cathodic protection. In particular the invention is suitable for subsea hydrocarbon extraction facilities.

2. Description of Related Art

Metal items and surfaces which are deployed underwater, particularly subsea, are prone to corrosion, due to the electrolytic nature of the surrounding liquid. Such corrosion may result in underwater equipment failures with consequently significant costs of downtime and replacement.

A standard technique for reducing corrosion after deployment of underwater equipment is to use cathodic protection, commonly abbreviated to "CP". A widely-used form of CP is "galvanic anode CP", in which a sacrificial metal surface is positioned proximate to the metal item to be protected. A sacrificial metal material is chosen which has a greater magnitude electrochemical potential than the item to be protected. Commonly used sacrificial metal materials include alloys of zinc, magnesium and aluminium for example. When located subsea for example, the sacrificial metal material will be corroded preferentially to the item. Eventually, the sacrificial material will be corroded to such an extent that replacement of the sacrificial material is necessary.

The effectiveness of the CP, which is primarily dependent on the amount of corrodible sacrificial material remaining, may be monitored by measuring the potential between the metal item to be protected and the surrounding liquid, as is well-known in the art. For subsea CP for example, it is common to use silver chloride-based (AgCl) electrodes for this purpose. International standards are set which govern CP design, a current example being DNV-RP-B401. Currently, these standards recommend that effective corrosion protection of subsea equipment is not assumed until a potential of −0.8V (Ag|AgCl|seawater) across the system is attained. It is therefore necessary to monitor potentials on the equipment to ensure that the required level of CP is met.

BRIEF SUMMARY OF THE INVENTION

In the subsea hydrocarbon extraction industry, currently available methods of subsea CP monitoring involve deploying remotely operated vehicles (ROVs) subsea to measure the CP potential periodically. This is a cost and time-intensive procedure, especially if the ROV is deployed solely for this purpose.

It is an aim of the present invention to overcome this problem and eliminate the current necessity for subsea intervention for CP monitoring. This aim is achieved by enabling the CP potential to be monitored from the surface, i.e. from a topside facility located onshore or on a vessel or rig. In this way the present invention provides remote condition monitoring and diagnostics for CP monitoring.

According to a first aspect of the present invention there is provided a method of monitoring cathodic protection of an item located underwater at a facility, the facility further including a processing means, comprising the steps of providing a pair of first and second electrodes—the first electrode being electrically connected to the item and the second electrode being in contact with water proximate the item, measuring the potential between the first and second electrodes, producing an electrical signal indicative of the cathodic protection level, converting the signal into a communications format compatible with the processing means and passing it to the processing means, and transmitting the converted signal from the processing means to a surface location.

In accordance with a second aspect of the present invention there is provided an underwater facility having an item requiring cathodic protection, comprising a pair of first and second electrodes—the first electrode being electrically connected to the item and the second electrode being in contact with water proximate the item, means for measuring the potential between the first and second electrodes and producing an electrical signal indicative of the cathodic protection level, a transducer for converting the signal into a communications format compatible with the processing means, a processing means, means for passing the converted signal to the processing means, and transmission means for transmitting the converted signal from the processing means to a surface location.

In accordance with a third aspect of the present invention there is provided an underwater hydrocarbon extraction facility according to the second aspect.

The present invention thereby provides, inter alia, the following advantages: instantaneous and real-time monitoring of the level of CP is achievable, the invention may be fitted to otherwise standard underwater equipment, for example a subsea electronics module of a subsea well structure, overprotection or underprotection of equipment can be quickly detected and rectified, and the costs associated with ROV intervention are eliminated.

BRIEF DESCRIPTION OF THE DRAWINGS

The invention will now be described with reference to the accompanying FIG. 1, which schematically shows a subsea well structure in accordance with an embodiment of the invention.

DETAILED DESCRIPTION OF THE INVENTION

Figure 1:
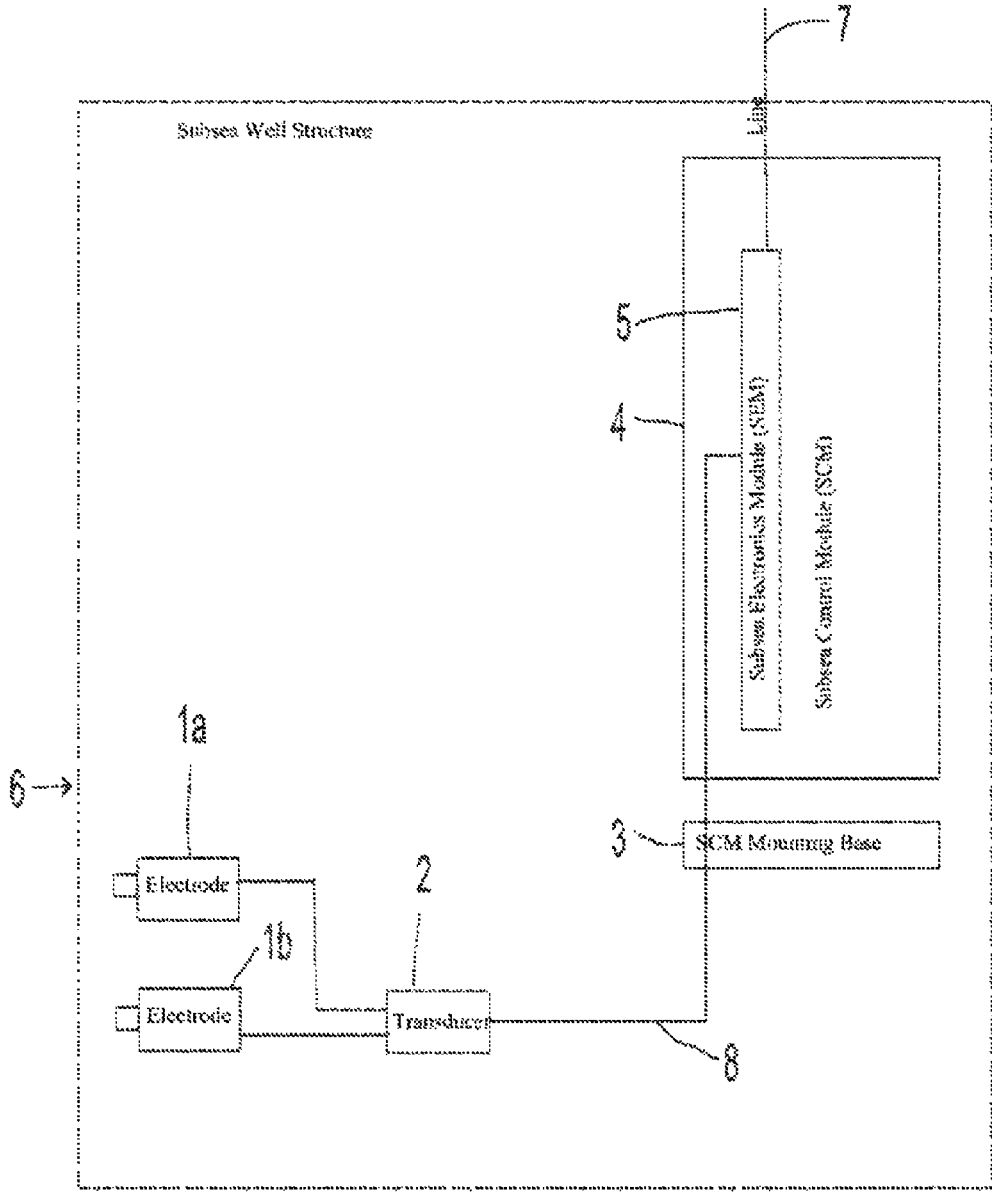
FIG. 1 shows a diagrammatic representation of a subsea well structure 6, in this embodiment a subsea well tree of a hydrocarbon extraction facility, enabling monitoring of the CP in accordance with the present invention.
Figure 2:
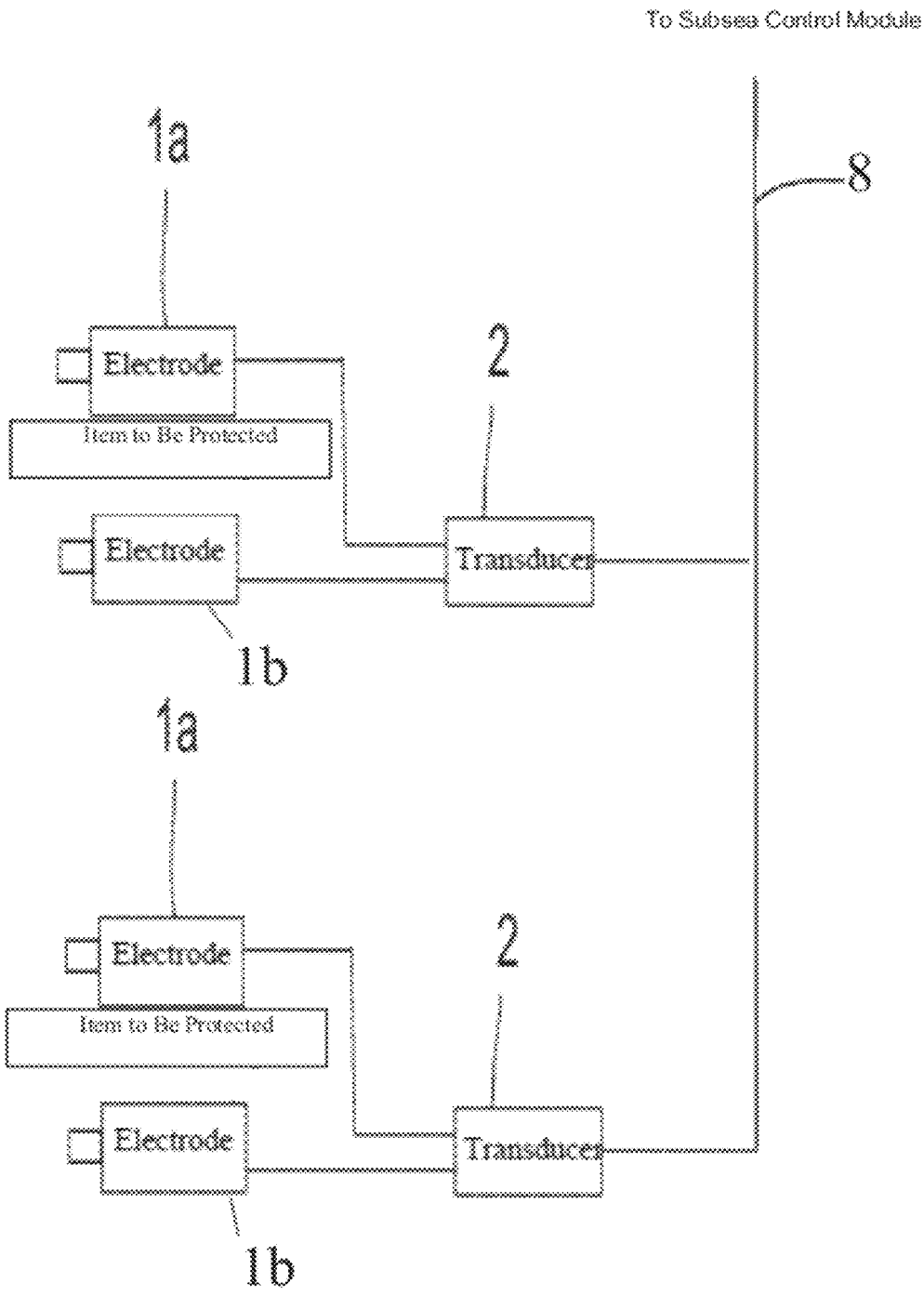
FIG. 2 is a schematic diagram illustrating application of multiple pairs of electrodes to provide for measuring electrical potentials to determine a cathodic protection for a plurality of items to be protected.

A pair of reference electrodes 1*a* and 1*b* are fitted to the structure, such that the first electrode 1*a* is electrically connected to the item to be protected, and the second electrode is positioned in contact with the water proximate the item. Here, the term "proximate" is used to denote water which is close enough to the item to enable a useful CP indication to be obtained, such distances being known in the art. These electrodes enable the measurement of the electrical potential (known as the "CP potential") between the item and the surrounding seawater. The electrodes 1*a*, 1*b* may for example be zinc-based, or other materials as is known in the art, e.g. silver chloride. An electrical signal indicative of the cathodic protection level is thereby produced by the electrodes.

The potential is fed to a transducer 2, containing electronics, which converts the potential to a 4-20 mA interface. This interface can be any communications format, for example CANbus, Profibus or Modbus, which is compatible with, and can be interpreted by the processing means 5 of the structure 6 (see below). In other words, the potential is transformed into a signal compatible with the communication protocol employed by the processing means 5.

The converted signal is then transmitted, via cables 8, through a subsea control module mounting base (SCMMB) 3, and passed to processing means 5, in this case a subsea electronics module (SEM). The SEM 5 is typically located within a subsea control module (SCM) 4.

The data is then transmitted from the SEM 5 to a surface location, for example topside facilities 9 such as a master control station (MCS). A line 7 is used for this transmission. Line 7 comprises an existing line within an umbilical cable (not shown) linking the subsea facility and the surface as is known in the art, so that the existing communication system between the SEM 5 and topside may be employed to transfer the data to the MCS. Once there, the data may be interpreted and displayed to a subsea equipment operator.

Various alternatives and modifications within the scope of the invention will be apparent to those skilled in the art. For example, the invention may be applied to any other underwater structures under CP, for example umbilical termination assemblies, subsea distribution units (SDUs), manifolds, etc.

Multiple measuring points, using electrode pairs spaced about the structure, are also possible. In this case, each electrode pair may be linked to a network bus, connected to the SEM. The use of multiple measuring points enables the effectiveness of the CP to be monitored in a variety of locations about the structure. Typically, these locations would be selected for the level of criticality to the facility.

The CP may be monitored either continuously or intermittently as required.

What is claimed is:

1. A method of monitoring cathodic protection of an item receiving cathodic protection located underwater at an underwater hydrocarbon extraction facility from a topside facility located onshore on a vessel or rig, the facility further including a subsea electronics control module, the method comprising the steps of:

providing a pair of first and second electrodes;

electrically connecting the first electrode to an item requiring cathodic potection located underwater at an underwater hydrocarbon extraction facility;

positioning the second electrode being in contact with water proximate the item;

producing an electrical signal indicative of a cathodic protection level of the item;

converting the signal into a communications format compatible with the subsea electronics control module;

passing the converted signal to the subsea electronics module;

transmitting the converted signal from the subsea electronics module to a surface location along a line within an umbilical cable; and determining the cathodic protection level of the item responsive to the converted siginal.

2. A method according to claim 1, wherein the communications format compatible with the subsea electronics module comprises CANbus.

3. A method according to claim 1, wherein the communications format compatible with the subsea electronics module comprises profibus.

4. A method according to claim 1, wherein the communications format compatible with the subsea electronics module comprises modbus.

5. A method according to claim 1, wherein the pair of first and second electrodes comprises a first pair of first and econd electrodes wherein the item requiring cathodic protection is a first item requiring cathodic protection, the method further comprising the steps of:

providing a second pair of electrodes, a first electrode of the second pair of electrodes being electrically connected to a second item requiring cathodic protection positioned at a different location than the first item, and a second electrode of the second pair of electrodes being in contact with water proximate the second item;

producing an electrical signal indicative of the cathodic protection level of the second item;

converting the respective signal into a communications format compatible with the subsea electronics module;

passing the converted signal indicative of the cathodic protection level of the second item to the subsea electronics module; and determining the cathodic protection level of the second item responsive to the potential between electrodes of the second pair of electrodes.

6. A method according to claim 5, wherein the signal is passed to the subsea electronics module on a network bus.

7. A system for monitoring cathodic protection of an item receiving cathodic protection located underwater at an underwater hydrocarbon extraction facility from a topside facility located onshore or on a vessel or rig, the system comprising:

an underwater hydrocarbon extraction facility having an item requiring cathodic protection;

a pair of electrodes, a first electrode of the pair of electrodes being electrically connected to the item requiring cathodic protection and a second electrode being in contact with water proximate the item, the first and the second electrodes being operably positioned to produce a potential therebetween and an electrical signal indicative of a cathodic protection level;

a subsea electronics module;

a transducer for converting the signal into a communications format compatible with the subsea electronics module;

one or more cables operably coupled between the transducer and the subsea electronics module to pass the converted signal to the subsea electronics module;

an umbilical cord positioned to transmit the converted signal from the subsea electronics module to a surface location; and a topside facility located at the surface location, configured to analyze the converted signal to thereby determine the cathodic protection level of the item requiring cathodic protection.

8. A system according to claim 7, wherein the transducer converts the signal to a CANbus format.

9. A system according to claim 7, wherein the transducer converts the signal to a profibus format.

10. A system according to claim 7, wherein the transducer converts the signal to a modbus format.

11. A system according to claim 7, wherein the pair of first and second electrodes is a first pair of first and second electrodes, the system comprising a second pair of electrodes, a first electrode of the second pair of electrodes being electrically connected to a second item requiring cathodic protection positioned at a different location than the first item, and a second electrode of the second pair of electrodes being in contact with water proximate the second item.

12. A system according to claim 11, comprising a network bus connecting each electrode pair and the subsea electronics module.

13. A method of monitoring cathodic protection of an item receiving cathodic protection located underwater at an underwater hydrocarbon extraction facility from a topside facility located onshore or on a vessel or rig, the method comprising the steps of:

providing a pair of first and second electrodes;

electrically connecting the first electrode to an item requiring cathodic protection located underwater at an underwater hydrocarbon extraction facility;

positioning the second electrode in contact with water proximate the item;

producing an electrical signal indicative of a cathodic protection level of the item;

converting the signal into a communications format compatible with the subsea electronics control module, the step of converting performed by a transducer;

passing the converted signal from the transducer to the subsea electronics control module;

transmitting the converted signal from the subsea electronics control module to a topside facility positioned at surface location via a line within an umbilical cable; and determining the cathodic protection level responsive to the converted signal, the step of determining performed at the topside facility.

14. A method as defined in claim 13, wherein the topside facility is a master control station (MCS).

* * * * *